US005568008A

United States Patent [19]

Narita

[11] Patent Number: 5,568,008

[45] Date of Patent: Oct. 22, 1996

[54] METAL HALIDE LAMP WITH A ONE-PART ARRANGEMENT OF A FRONT COVER AND A REFLECTOR

[75] Inventor: Mitsuo Narita, Himeji, Japan

[73] Assignee: Ushiodenki Kabushiki Kaisha, Japan

[21] Appl. No.: 395,505

[22] Filed: Feb. 27, 1995

[30] Foreign Application Priority Data

Feb. 25, 1994 [JP] Japan ..... 6-051102
Apr. 20, 1994 [JP] Japan ..... 6-104407

[51] Int. Cl.[6] ..... H01J 5/16; H01J 61/40; H01J 17/04; H01J 61/04

[52] U.S. Cl. ..... 313/113; 313/620

[58] Field of Search ..... 313/197, 217, 313/113, 229, 620, 634, 638

[56] References Cited

U.S. PATENT DOCUMENTS 4,302,699 11/1981 Keeffe et al. ..... 313/229
4,308,483 12/1981 Keefe et al. ..... 313/229 X
4,320,322 3/1982 Rothwell, Jr. et al. ..... 313/217
4,321,501 3/1982 English et al. ..... 313/197
4,321,504 3/1982 Keeffe et al. ..... 313/229 X
4,612,000 9/1986 English et al. ..... 313/634 X
4,620,130 10/1986 Keeffe et al. ..... 313/634
4,636,687 11/1987 Keeffe et al. ..... 313/620
4,937,495 6/1990 Gosslar et al. ..... 313/620 X

*Primary Examiner*—Sandra L. O'Shea
*Assistant Examiner*—Mack Haynes
*Attorney, Agent, or Firm*—Sixbey, Friedman, Leedom & Ferguson, P.C.; David S. Safran

[57] ABSTRACT

A lamp device having one-piece arrangement of a metal halide lamp and a reflector which has a front cover in which a small, compact shape for installation of a halogen lamp can be obtained, which has characteristics of high efficiency, good color reproduction and high power. The lamp has a unidirectional base and a unidirectional sealed end which is configured such that it is surrounded by a front cover and a reflector.

5 Claims, 4 Drawing Sheets

FIG. 1A FIG. 1B
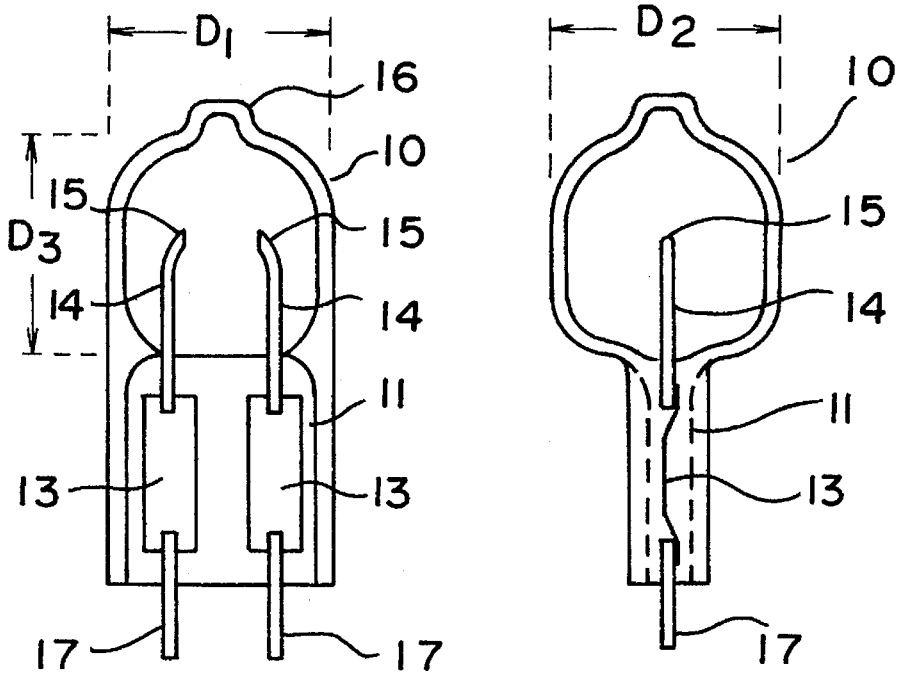
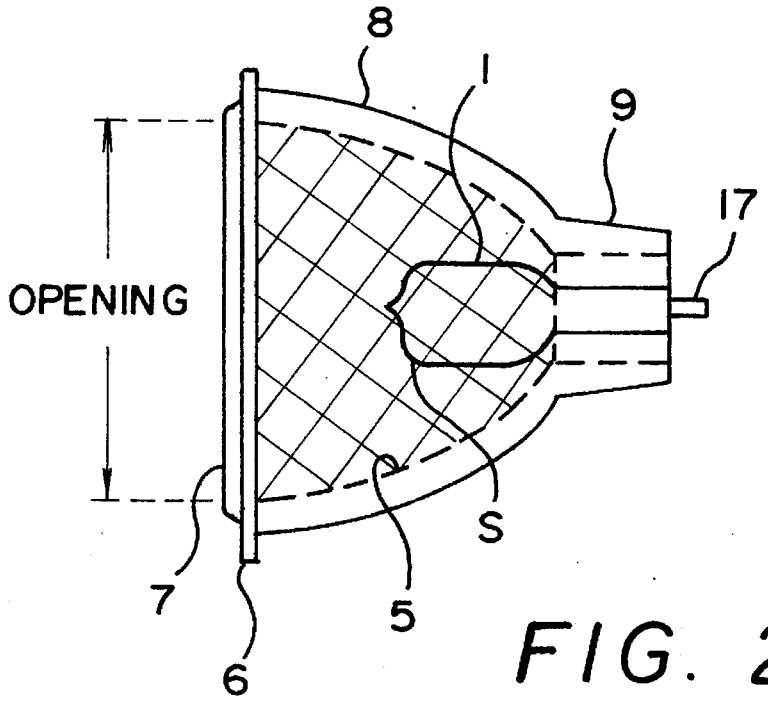
FIG. 2

METAL HALIDE LAMP WITH A ONE-PART ARRANGEMENT OF A FRONT COVER AND A REFLECTOR

BACKGROUND OF THE INVENTION

1. Field of the Invention

The invention relates to a discharge lamp with a unidirectional base and a unidirectional, sealed end which has a front cover and a reflector. A lamp of this type is used for light filament illumination using optical fibers, for spot lighting, such as shop lighting or the like, and for a light source for purposes of projection, which is installed in a projector, such as an OHP, liquid crystal projector and the like.

2. Background of the Disclosure

Ordinarily a halogen lamp with unidirectional base and unidirectional, sealed end together with a reflector is used for light filament lighting using optical fibers, for spot lighting in shop lighting or the like, or for a light source for purposes of projection of an OHP, liquid crystal projector or the like. In the case in which a halogen lamp is used as a light source, the following disadvantages however arise:

1) The lighting intensity which is obtained with regard to starting power is low. To obtain sufficient lighting intensity on a projection surface, it is necessary to provide especially strong power for the lamp.
2) The fight emitted from the lamp contains a large amount of infrared radiation. In the case in which the lamp is installed in devices of different types, it is therefore necessary to use, at the same time, an infrared absorption filter, an infrared reflection filter and the like in order to reduce the temperature on an irradiated surface or within a device.
3) To obtain good color reproduction, the color temperature of the lamp must be set relatively high. In this case, however, due to burn-out of a filament, the service life of the lamp is shortened. Burn-out of the filament takes place, for example, after 35 to 50 hours when the color temperature of the lamp is set to roughly 3200° K.

Based on the above-described circumstances, a metal halide lamp which is installed in a reflector is used instead of a halogen lamp. A metal halide lamp of this type is more advantageous than a halogen lamp with respect to high efficiency, good color reproduction and high power. However, for purposes of stabilization of the outside peripheral temperature of the lamp during illumination or for similar purposes, it has a double tube arrangement in which there is one outside tube. In this case, the device is rather large as a whole if a metal halide lamp of the double tube type is installed in the reflector.

In addition, a metal halide lamp with a bilateral base and with bilateral sealed ends can be installed in a reflector without providing an outside tube. In this case, however, the lamp as a whole has a greater length than for a unidirectional base, and as a result a large reflector is needed, or the disadvantage arises that the tip of the lamp projects out of the front opening of the reflector if a smaller reflector is used.

On the other hand, there are cases in which a front cover, such as transparent glass or the like, is provided in the front opening of the reflector. This front cover can prevent fouling of the lamp surface or reflecting surface of the reflector as a result of adhesion of dirt. The front cover can, furthermore, prevent shifting of the lamp position by contact with other parts, even when an integrated reflector/lamp arrangement is installed in a device, such as a projector or the like. In addition, the front cover can minimize damage, even if the lamp breaks, although the possibility of breaking of a metal halide lamp during illumination is generally on the order of 1 to 1 million, subsequently called the "PPM level", and is extremely low. It is, therefore, desirable to provide a front cover for the one-part arrangement of the metal halide lamp and reflector which is arranged such that it surrounds the metal halide lamp.

SUMMARY OF THE INVENTION

Therefore, the primary object of the invention is to devise a metal halide lamp with a one-part arrangement of a front cover and a reflector in which, to exploit the special desired characteristic of high efficiency, good color reproduction and high power, a metal halide lamp is used as a light source in which, even after installation in a reflector, a small compact form can be obtained, in the same manner as in the installation of a halogen lamp.

This object is achieved according to a preferred embodiment of the invention by a metal halide lamp with a one-part arrangement of a front cover and a reflector having the following features:

1) The thickness of a bulb which forms the emission part of the metal halide lamp, T (mm), the distance between the electrodes thereof, L (mm), and the lighting voltage of the lamp, V (volt), bear the following relationship to each other:

$$10<V/(L*T)<25$$

2) The outside diameter of a front side of the bulb which forms the emission part of the metal halide lamp, $D_1$ (mm), the outside diameter of a side of the above-described bulb, $D_2$ (mm), the length of the above-described bulb, $D_3$ (mm), and the lighting power of the lamp, W (watt), bear the following relationship to each other:

$$0.07<W/(D_1*D_2*D_3)<0.20$$

3) The volume of an area which is surrounded by the front cover and the reflector, $Q_1$ ($cm^3$), and the volume of the bulb which forms the emission part of the above-described metal halide lamp, $Q_2$ ($cm_3$), bear the following relationship to each other:

$$Q_1/Q_2<15$$

4) The thickness of the bulb which forms the emission part of the metal halide lamp, T (mm), the distance between the electrodes thereof, L (mm), the lighting voltage of the lamp V (volt), the outside diameter of a front side of the above described bulb, $D_1$ (mm), the outside diameter of a side of the above-described bulb, $D_2$ (mm), the length of the above-described bulb $D_3$ (mm), and the lighting power of the lamp W (watt), bear the following relationship to each other:

$$10<V/(L*T)<25$$

$$0.07<W/(D_1*D_2*D_3)<0.20$$

5) $T_2/T_1$ is greater than or equal to 1.6, where $T_1$ (mm) is the thickness of the bulb which forms the emission part of the above-described lamp, and $T_2$ (mm) is the thickness of the glass of the front cover, in the case in which the operating pressure of the lamp during illumination is $3\times10^6$ Pa, the inside volume of the lamp is 1 $cm^3$ and the distance between the light source and the front cover glass is 20 mm.

The inventors have found that in a metal halide lamp with a unidirectional base and a unidirectional sealed end which hereinafter is called a "lamp" and is configured such that it is surrounded by a front cover and a reflector, special effects are obtained which are not present in conventional examples by the limitation, according to the invention, to certain physical and structural quantities, hereinafter called numerical values, based on the following factors, and the above-described object can be achieved.

1) First, the inventors found that by defining the thickness of a bulb which forms the emission part of the lamp, the distance between the electrodes and the lighting voltage of the lamp, a still smaller probability of breakage of the lamp than the conventional PPM level can be obtained.

2) Second, the inventors found that by defining the size of the bulb which forms the emission part of the lamp and the lighting voltage of the lamp, an even more advantageous lamp characteristic, especially good color reproduction, can be achieved.

3) Third, the inventors found that also by defining the ratio between the volume of the area which is surrounded by the front cover and the reflector and the volume of the bulb which forms the emission part of the lamp, within an optimal numerical range illumination with advantageous lamp characteristics, especially with good color temperature and good color reproduction, can be effected.

4) Fourth, the inventors have found that in the case of a relatively small lamp shape, by defining the ratio between the thickness of the bulb which forms the emission part of the lamp and the thickness of the front cover, safety can be adequately guaranteed, even if the lamp breaks during illumination.

These and further objects, features and advantages of the present invention will become apparent from the following description when taken in connection with the accompanying drawings which, for purposes of illustration only, show several aspects of a preferred embodiment in accordance with the present invention.

BRIEF DESCRIPTION OF THE DRAWING

FIGS. 1A & 1B schematically show an example of a metal halide lamp according to the present invention in front and side views, respectively;

FIG. 2 schematically shows the lamp according to the invention in a one-piece arrangement of a front cover and a reflector;

DETAILED DESCRIPTION OF THE PREFERRED EMBODIMENT

Figure 3:
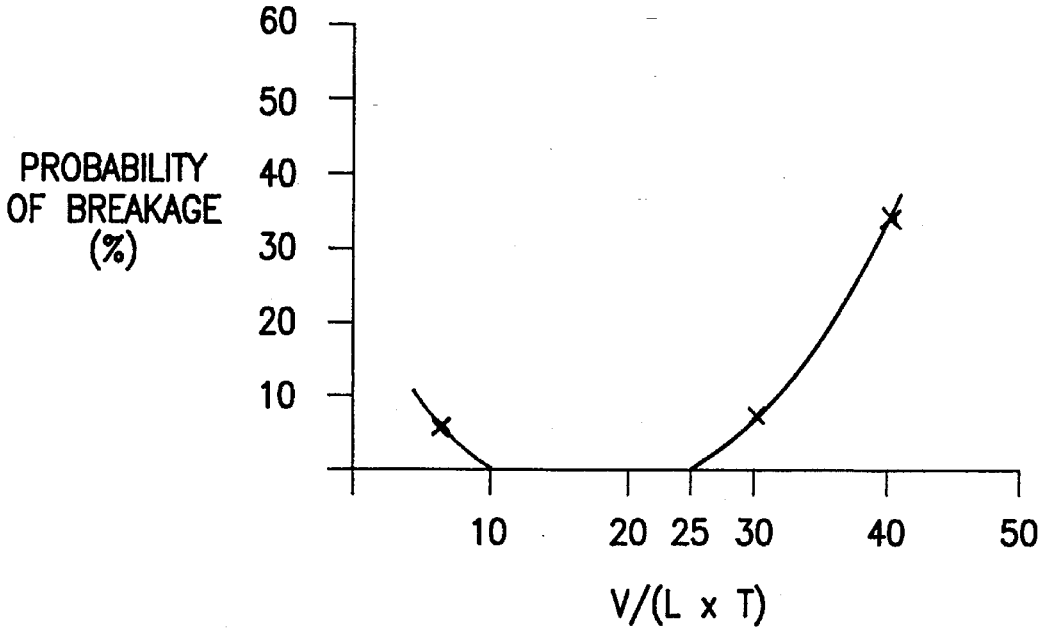
FIG. 3 graphically depicts a test result for explaining an aspect of the invention.

FIG. 1 schematically shows a metal halide lamp according to the invention, hereinafter abbreviated to the "lamp". FIG. 2 is a schematic of the state in which a lamp of this type is installed in a reflector and a front cover.

With reference to the drawings a metal halide lamp 1 with a lamp input power of, for example 150 W, is formed of quartz glass, and has an emission part 10 and a hermetically enclosed part 11. The lamp has a so-called unidirectional base and a so-called unidirectional sealed end in which hermetically enclosed part 11 is formed at only one end of the lamp tube. A pair metal foils 13 formed of molybdenum, or the like, are located in the hermetically enclosed part 11. To each of the metal foils 13, an inner terminal post 14 is connected, which extends from its connection within the hermetically enclosed part 11 into the emission part 10. An electrode 15 is formed on the tip of each inner terminal pin 14.

Emission part 10 defines a roughly oval discharge space with an internal surface of, for example, 0.3 cc enclosed within a quartz glass bulb which separates this discharge space from the outside. Encapsulated in this emission part 10 are selected metal halides, for example, dysprosium iodide, neodymium iodide and cesium iodide, a selected amount of mercury and also argon as the starting inert gas for illumination. For example, roughly 0.6 mg of the metal halides with a total amount of 14 mg of mercury as well as 7000 Pa (at a reference temperature of 25° C.) argon are encapsulated.

The reason for using rare earth metals for the above-described metal halides is that visible radiation can be advantageously obtained. Besides the aforementioned examples, scandium, holmium, thulium, erbium and praseodymium can likewise be used. In addition, together with these rare earth metals, sodium, aluminum, thallium, tin, indium, lithium and the like can be added. In this case, emission characteristics of the lamp can be corrected and improved. Specifically, indium contributes to an improvement of blue emission characteristics and lithium to an improvement of red emission characteristics.

Furthermore, it stands to reason that neon, xenon, krypton and the like can also be used as the starting gas.

Electrode 15 is located on the tip of inner terminal pin 14 which, for example, is formed of pure tungsten with a wire diameter of 0.5 mm or pure rhenium or a rhenium-tungsten alloy, or is formed by coating a tungsten wire with pure rhenium or a rhenium-tungsten alloy.

Inner terminal pin 14 on its base is connected to metal foil 13 of hermetically enclosed part 11, and at the same time, its tip is bent such that electrodes 15 are directed each other. This means that electrode 15 is formed by the tip of inner terminal pin 14 and in this case is a bent part. The term "electrode" here, however, should not be understood as restricted to this definition, encompasses any part which will contribute to discharge formation by emitting electrons. The bend angle of electrode 15 can be a right angle, i.e., 90°. However in this embodiment it is roughly 90±30 degrees. By means of this bend, the distance between the electrodes in this part is minimized, and only in this part can a discharge be reliably formed.

Electrode 15 can also be wound to roughly three to four times in the manner of a spiral with tungsten or thoriated tungsten; this is not shown in the drawing. By forming a spiral of this type, good electron emission is obtained, and at the same time, blackening of the fluorescent tube is prevented because the material comprising the spiral has a high melting point and therefore the frequency with which the electrode material sprays becomes relatively low.

In this embodiment, the distance between the electrodes is, for example, roughly 3.51 mm and the operating pressure within the bulb during lighting is about $2.6\times10^6$ Pa. The widthwise outside diameter $D_1$ of emission part 10, viewed in a direction perpendicular to the discharge direction, and the depthwise outside diameter $D_2$ of emission part 10 viewed in the discharge direction are each 12 mm. The length $D_3$ of emission part 10 in the direction in which the inner terminal pin 14 extends is 9 mm. Furthermore, emission part 10, apart from a projection-like part 16, has an essentially uniform thickness of, for example, 1.4 mm of the quartz glass. The inner volume of the bulb is roughly 0.3 cc. Furthermore, the glass bulb area of emission part 10 can be frosted.

In FIG. 2, front cover 7 is formed, for example, of a borosilicate glass and has a thickness of, for example, 3.2 mm. Furthermore the glass has been frosted to control the light distribution characteristic, or has been processed to have a lens function. The front cover is joined to reflector 8 by a connection using an aluminum ring 6.

In reflector 8, a vapor deposited film of aluminum or multilayer interference film 5 of titanium dioxide and silicon dioxide is formed on a substrate formed of glass. Reflector 8, for example, has the shape of the surface of a second degree paraboloid of revolution. The lamp 1 is disposed within reflector 8, and reflector 8 transmits infrared rays (mainly with wavelengths of greater than or equal to 780 nm) under radiant light from lamp 1, and at the same time, reflects visible radiation (mainly in a wavelength range from 380 to 780 nm) forward. The shape of reflector 8 is not limited to the surface of a second degree paraboloid of revolution, but can also be spherical. A cylinder 9 is formed as one part with reflector 8, into which lamp 1 is inserted and attached by means of an adhesive with a primary component of $Al_2O_3$, $SiO_2$ or the like, as by means of an inorganic, heat resistant cement or the like.

A metal halide lamp of this type with a one-piece arrangement of the front cover and reflector has, for example, an opening diameter of reflector 8 of 50 mm. The area 5 which is bounded by the front cover 7 and the reflector 8 (shown by crisscross hatching), without lamp 1, has a volume of 16 cc. The volume of lamp 1 with shape S is roughly 1.4 cc.

By defining the numerical ratios in the following manner, it has been determined that the probability of breakage of the lamp is reduced. That is, there are essentially two conceivable reasons for breakage of the lamp. One reason lies in the compressive strength of the fluorescent tube as a vessel against the operating pressure of the lamp. The other reason lies in the integrity of the hermetically enclosed part.

Therefore, a test was done in which, by means of different changes of the value of (V/(L*T)), the relation thereof to breakage of the lamp was checked, where T is the thickness of the bulb of the emission part 10 of the metal halide lamp in mm, L is the distance between electrodes 15 in mm, and V is the lighting voltage of the lamp in volts. In the test, lamps were produced in which the value of (V/(L*T)) was changed by changing the thickness T of the bulb of the emission part 10 and the distance L between the electrodes 15, and in which selected metals and a suitable amount of mercury have been encapsulated for control of the lamp voltage. The given lamp was operated with an input power of 1.5*150 W for a lighting period of 100 hours in order to ascertain whether the lamp would break or not, whereby the rated power is 150W.

FIG. 3 shows the result. It illustrates that the probability of breakage of the lamp increases when the value of (V/(L*T)) is greater than or equal to 25. The conceivable reason for this lies in that, under a condition of this type, the thickness of the bulb is relatively small, so that therefore the compressive strength of the bulb as a vessel against the operating pressure of the lamp becomes less, and that as a result thereof the lamp breaks.

On the other hand, the probability of breakage of the lamp, likewise, increases when the value of (V/(L*T)) is less than or equal to 10. The reason for this is that the thickness of the bulb is extraordinarily large. The quartz tube in the hermetically enclosed part is heated from the outside by means of a flame torch when it is manufactured. In doing so, the inside surface, due to the great thickness, is not as easily heated as its outside surface. Therefore, the quartz tube is in a state in which, on the inside surface, the viscosity of the quartz is relatively low, and is hermetically enclosed by pressure welding against the metal foil. Therefore, it is assumed that as a result integrity decreases. Thus, the relationship $10<V/(L*T)<25$ should be maintained.

A numerical range by which an even more advantageous lamp characteristic of especially good color reproduction can be achieved will now be described. In this description, the outside diameter of the bulb of emission part 10, which is viewed from the direction perpendicular to the discharge direction of the lamp 1 is designated $D_1$, the outside diameter of fluorescent tube 10 viewed in the discharge direction $D_2$, the length of the bulb of emission part 10 in the direction in which it extends from part 11 is $D_3$ (mm), and the lighting power of the lamp is W (watt).

The reason for this advantage is that, generally, for an overly high load of the tube wall of the lamp bulb on the inside surface, a reaction of the quartz (of which bulb is formed) with the rare earth metals encapsulated within it is quickly carded out, so that the quartz is clouded in a milk-like manner and that, as a result thereof, the amount of radiant light from the lamp is reduced.

The expression "loading of the lamp tube wall" is generally defined herein as the value of the fighting power of the lamp divided by the internal surface of the lamp. Since, however, it is difficult to determine the internal surface of the lamp, the value of $(D_1*D_2*D_3)$ is used as a substitute value for the internal surface. A value of $W/(D_1*D_2*D_3)$, therefore, designates a practical load of the lamp tube wall and by determining the numerical range thereof the aforementioned advantage can be achieved.

Figure 4:
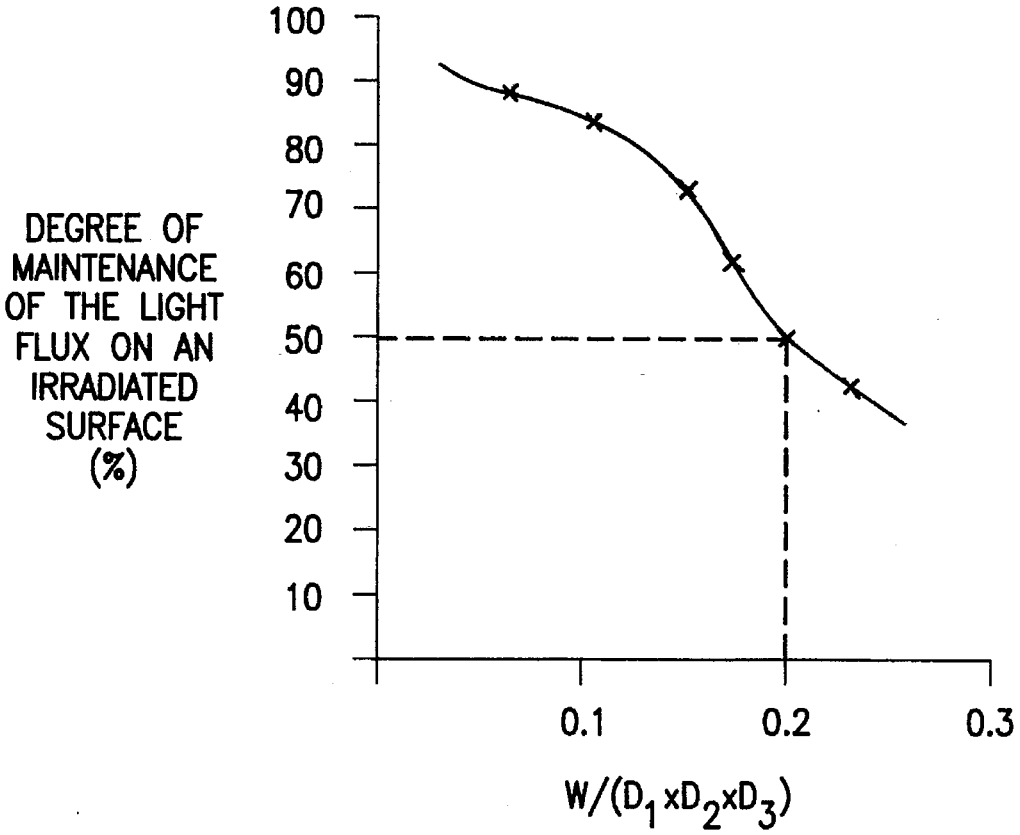
FIG. 4 graphically depicts a test result for explaining a second aspect of the invention.

FIG. 4 shows the degree of maintenance of the light flux on an irradiated surface during 100 hours of illumination by the lamp at which the value of $W/(D_1*D_2*D_3)$ was changed in a range of 0.03 to 0.25 $mm^3$. This means that, in this case, the comparison between a light flux after one hour of operation of the lamp and light flux after 100 hours of operation of the lamp is described.

In the test, lamps were produced in which the outside diameter $D_1$, $D_2$ and $D_3$, and lighting power W of the lamp were varied to produce different values of $W/(D_1*D_2*D_3)$. This lamp was formed integrally with the reflector, and a screen was arranged with a distance forward of 1 m on which 5 points were located for measuring lighting intensity, so that the average lighting intensity hereof was measured.

The test shows that the degree of maintenance of the light flux decreases to less than or equal to 50%, and that the quartz bulb of the emission part 10 is highly clouded in a milky fashion in the case in which the value of $W/(D_1*D_2*D_3)$ is greater than or equal to 0.2. On the other hand, in the case in which the value of $W/(D_1*D_2*D_3)$ is less than or equal to 0.03, the load of the lamp tube wall is too small, and the lamp is not usable due to the significant decrease of the light flux on the irradiated surface.

Figure 5:
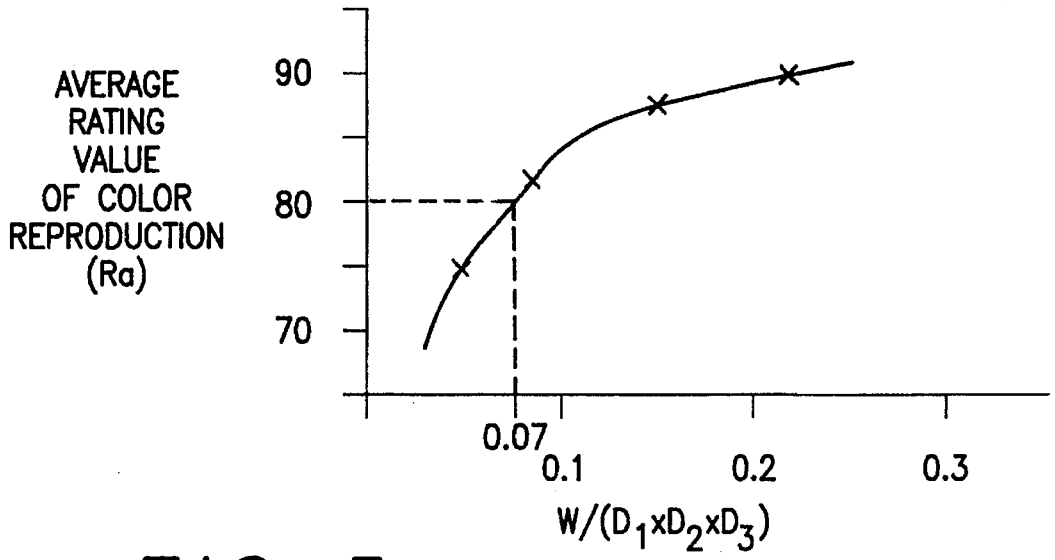
FIG. 5 graphically depicts a test result for explaining a third aspect of the invention.

FIG. 5 shows the average rating value of color reproduction on the irradiated surface, which is called "Ra" hereinafter, in which the value of $W/(D_1*D_2*D_3)$ was changed within the range of 0.03 and 0.25. The average rating value of color reproduction Ra is generally called good reproduction if it is greater than or equal to 85. If it is less than or equal to 80, it cannot be assumed that color reproduction is good. The figure shows that the average rating value of average color reproduction Ra is less than or equal to 80 in the case in which the value of $W/(D_1*D_2*D_3)$ is less than or equal to 0.7. Thus it becomes clear that, with respect to maintaining the light flux as the result of milky clouding of the fluorescent tubes and preservation of good color reproduction, it is desirable that the value of $W/(D_1*D_2*D_3)$ be greater than or equal to 0.07 and less than or equal to 0.2, i.e., $0.07<W/(D_1*D_2*D_3)<0.20$.

It was also found that, an optimum numerical range of the ratio between the volume $Q_1$ ($cm^3$) of the area surrounded by the front cover and reflector, and the volume $Q_2$ ($cm^3$) of the bulb of the emission part 10 of the lamp could be determined, within which luminous operation of the lamp with a good lighting characteristic, especially with an advantageous color temperature and advantageous color reproduction, can be effected.

In this case, by various changes of the value of $Q_1/Q_2$, a color temperature state was observed which is obtained by the radiation from the lamp. In the test, the lamp according to the invention with a one-part arrangement of the front cover and reflector was arranged such that the above-described lamp is horizontal, and the lamp was lighted. In this case, a location at a distance of 1 m frown the lamp was called the area to be irradiated, on which the color temperature was measured. A lamp with a rated output of 150 watts was used. To measure the color temperature, a colorimeter was used. In the test, the same lamp is operated each time using reflectors of different sizes, and in the given reflector, the period of time was measured with which the color temperature was essentially stabilized.

Figure 7:
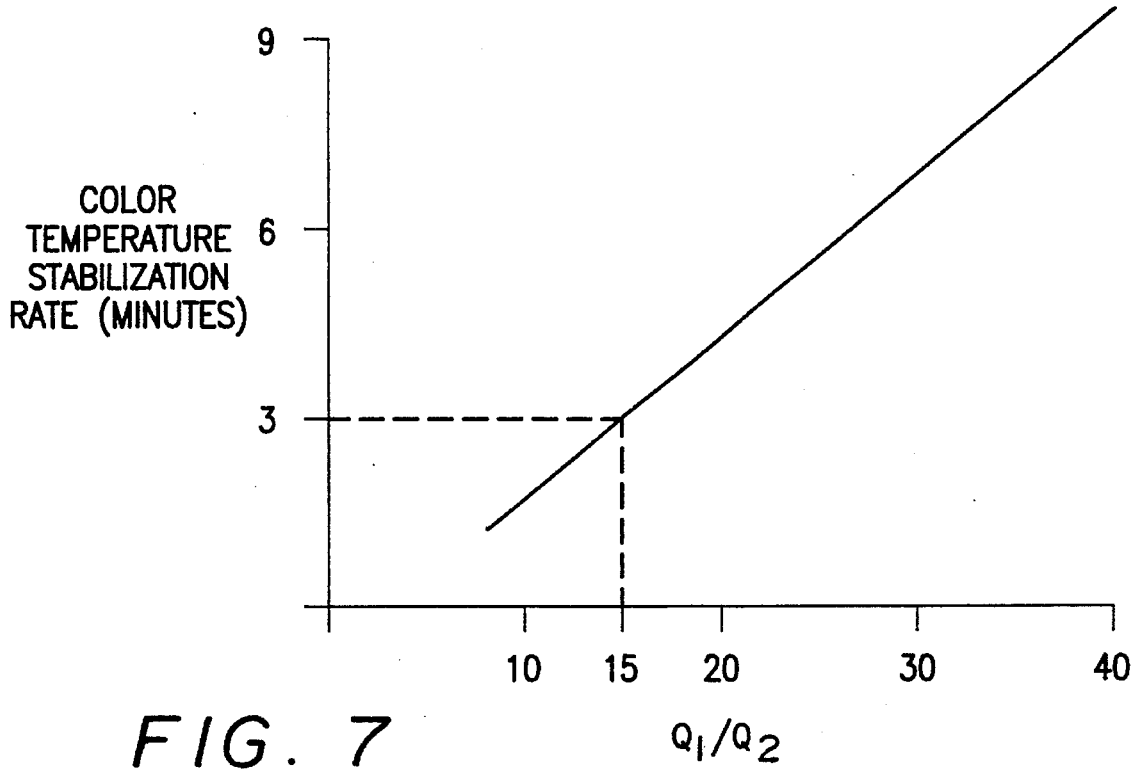
FIG. 7 graphically depicts a test result for explaining a fifth aspect of the invention.

The ratio between the stabilization time of the color temperature and ratio $Q_1/Q_2$, between volume $Q_1$ ($cm^3$) of the area enclosed by the front cover and reflector and volume $Q_2$ ($cm^3$) of the bulb which forms the emission part of the lamp, is illustrated using the graph in FIG. 7 from the result of the above-described test.

Figure 6:
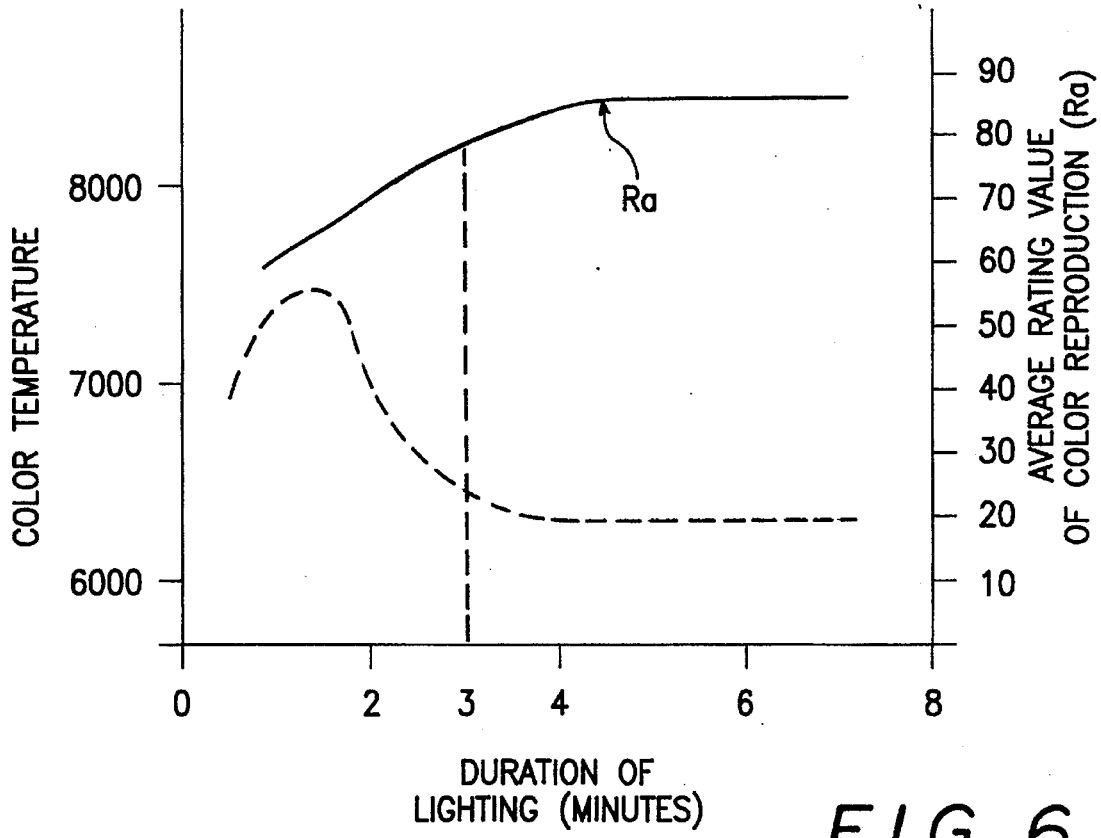
FIG. 6 graphically depicts a test result for explaining a fourth aspect of the invention.

FIG. 6 shows the length of time to stabilization of the color temperature and the rating value of color reproduction (Ra) after start-up of illumination by the lamp. In this test, as described above, the lamp according to the invention with a one-part arrangement of the front cover and the reflector was arranged such that the above described lamp lies horizontally, and the lamp was operated, a location with a distance of 1 m from the lamp being designated the surface to be irradiated, on which the color temperature and the rating value of color reproduction were measured. The same lamp as in FIG. 7 was used. The color temperature was likewise measured in the same manner. This shows that both the color temperature and the rating value of color reproduction were stabilized after an essentially identical time after start-up of illumination by the lamp, which was roughly 3 minutes in the tests.

A graph which reproduces the test data is shown in FIG. 7 and clearly shows that the color temperature is stabilized within about 3 minutes after start-up of illumination by the lamp, and that, in this case, with respect to practical use there is no problem when the value of $Q_1/Q_2$ is less than 15. This phenomenon can be explained as follows:

A case in which the value of $Q_1/Q_2$ is small means that volume $Q_2$ ($cm^3$) of the bulb which forms the emission part 10 of the lamp is greater than volume $Q_1$ ($cm^3$) of the area enclosed by the front cover and the reflector, excluding that taken up by the lamp itself, i.e., the free or unoccupied volume of this enclosed area. The lamp can quickly reach a thermal equilibrium state within an atmosphere which is hermetically enclosed within the reflector. Furthermore, in this hermetically enclosed atmosphere the convection loss of heat is suppressed, and in this way, the temperature of the coolest part of the lamp increases.

In the case in which the value of $Q_1/Q_2$ is large, it conversely takes a long time until the thermal equilibrium state is reached and furthermore the convection loss is increased because the volume within the reflector, in spite of the hermetic enclosure within the reflector, is relatively large with respect to the volume of the lamp.

As is apparent from the test shown in FIG. 6, color reproduction is stabilized after essentially the same time as the color temperature. To achieve luminous operation of the lamp with good color reproduction, therefore, the value of $Q_1/Q_2$ must satisfy the condition for production of a good characteristic of the color temperature, i.e., be less than 15.

By combining the condition of numerical value limitation of the relationship $10<V/(L*T)<25$ with the condition of the numerical value limitation $0.07<W/(D_1*D_2*D_3)<0.20$, luminous operation with a good lighting characteristic of the lamp, especially with good color reproduction, is achieved and at the same time the probability of breakage of the lamp can be reduced.

In the following, according to the invention, it was found that in a lamp with a one-part arrangement of a front cover and reflector with a relatively small shape in which the operating pressure of the lamp during luminous operation is does not exceed $3\times10^6$ Pa, the inside volume of the lamp is within 1 cm and the distance between a lamp and front cover is within 20 mm, by limiting the value of ratio $T_2/T_1$ between the thickness $T_1$ (mm) of the bulb which forms the emission part 10 of this lamp and thickness $T_2$ (mm) of the front cover to an optimum numerical range, lamp safety can be adequately guaranteed, even if the lamp breaks during lighting operation.

This means that the inventors have found that the energy which causes the lamp to break is stored as operating pressure within the fluorescent tube of the lamp, and that the amount of energy is designated using the product between the operating pressure and inside volume of the fluorescent tube of the lamp. In addition, the inventors have found that, if this condition prevails within the stipulated area, by determining the ratio between the thickness of the fluorescent tube which forms the lamp and the thickness of the front cover, lamp safety can be adequately guaranteed, even if it breaks.

Figure 8:
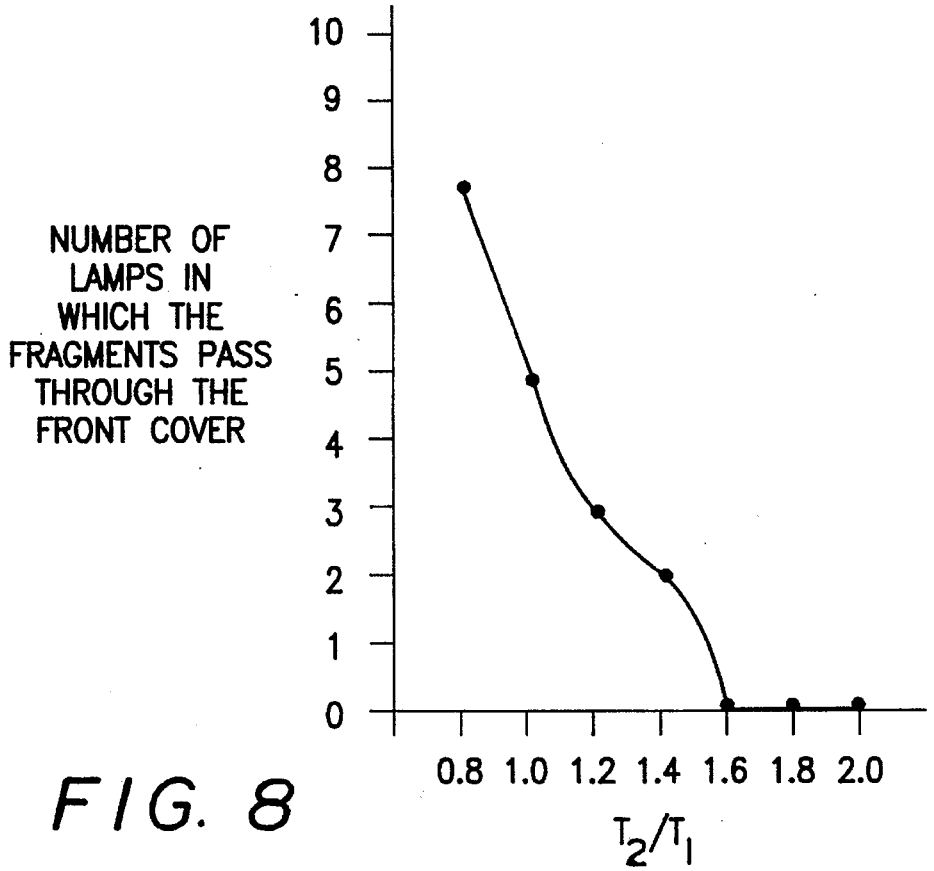
FIG. 8 graphically depicts a test result for explaining a sixth aspect of the invention.

FIG. 8 illustrates a test which proves that by defining the ratio between the thickness of the bulb which forms the emission part 10 of the lamp according to the invention and the thickness of the front cover, lamp safety of the lamp can be adequately guaranteed even if the lamp breaks.

In this case, a lamp with a one-part arrangement of the front cover and the reflector with an operating pressure of $3\times10^6$ Pa and an inside volume of 1 $cm^3$ was installed in the reflector, such that the distance between the lamp and the front cover is within 20 mm. The lamp was intentionally operated with an input power above the normally approved maximum value, and the degree of penetration of fragments through the front cover which results from breakage of the bulb in the case of an intentionally caused breakage was studied.

The test was conducted such that the value of ratio $T_2/T_1$ between thickness $T_1$ (mm) of the fluorescent tube which forms the lamp and the thickness $T_2$ (mm) of the front cover was changed, and that using 10 lamps, it was measured with reference to the given ratio in how many of the lamp fragments formed during breakage penetrated the front cover. FIG. 8 shows that, in the case in which the value of $T_2/T_1$ is less than 1.6, penetration of fragments was confirmed with a relatively high frequency, while for $T_2/T_1$ of greater than or equal to 1.6, crack formations in the front cover occurred, penetration of fragments and spraying thereof forward however did not.

This result can be explained as follows.

In the case in which $T_2/T_1$ is less than 1.6, the strength of the front cover with respect to the impact energy of the fragments of the bulb which collide with the front cover upon breakage is relatively small, and as a result the fragments penetrate, while for $T_2/T_1$ of greater than or equal to 1.6 the opposite occurs. In addition, the impact energy of the fragments is in proportion to their mass and the mass of the fragments is in proportion to the thickness. On the other hand, the strength of the front cover is in proportion to its thickness. Therefore, by defining ratio $T_2/T_1$ between these two variables, the safety of the discharge lamp against breaking can be guaranteed.

According to the invention, the operating pressure of the lamp during illumination, the inside volume of the lamp, and the distance between the lamp and the front cover are restricted to a stipulated range. The reason for the small range limited to a certain degree, therefore, lies in that it is assumed that the lamp according to the invention is used instead of a conventional halogen lamp.

ACTION OF THE INVENTION

As described above, the metal halide lamp according to the invention with a one-part arrangement of the front cover and the reflector has the following effects:

1) By defining the thickness T of a fluorescent tube which comprises the lamp, the distance between the electrodes L and the lighting voltage of the lamp V, according to the relationship $10<V(L*T)<25$, a still smaller probability of breakage of the lamp than the conventional PPM level can be obtained.

2) By defining the volumetric size of the bulb which forms the emission part of the lamp ($D_1*D_2*D_3$) and the lighting power W of the lamp according to the relationship $0.07<W/(D_1*D_2*D_3)<2.0$, an even more advantageous lamp characteristic, especially good color reproduction, can be achieved.

3) By defining the ratio between the volume of the area which is surrounded by the front cover and the reflector $Q_1$ and the volume of the bulb which forms the emission part of the lamp $Q_2$, within an optimal numerical range of $Q_1/Q_2<15$, illumination with advantageous lamp characteristics, especially with good color temperature and good color reproduction, can be effected.

4) In the case in which the operating pressure of the lamp during luminous operation is does not exceed $3\times10^6$ Pa, the inside lamp volume does not exceed 1 $cm^3$ and the distance between the light source and the glass of the front cover is within 20 mm, by determining the value of $T_2/T_1$ to be greater than or equal to 1.6, lamp safety even in the case of breakage during luminous operation can be adequately guaranteed if the thickness of the fluorescent tube which forms the above-described metal halide lamp is designated $T_1$ (mm) and the thickness of the glass of the front cover $T_2$ (mm).

It is to be understood that although preferred embodiments of the invention have been described, various other embodiments and variations may occur to those skilled in the art. Any such other embodiments and variations which fall within the scope and spirit of the present invention are intended to be covered by the following claims.

What we claim is:

1. A metal halide lamp device with a one-piece arrangement of a front cover and a reflector, and with a metal halide lamp, said metal halide lamp having a unidirectional base and a unidirectional sealed end and being positioned within an inner space defined by the front cover and reflector so as to be surrounded thereby; wherein the metal halide lamp is configured in accordance with the relationship: $10<V/(L*T)<25$, where T is a wall thickness between inner and outer surfaces of a bulb which forms an emission part of the metal halide lamp in mm, L is a distance electrodes of the lamp in mm and V is a lighting voltage of the lamp in volts.

2. A metal halide lamp device according to claim 1, wherein the metal halide lamp is also configured in accordance with the relationship $0.07<W/(D_1*D_2*D_3)<0.20$, where $D_1$ is an outside dimension of a front side of a bulb which forms an emission part of the metal halide lamp in a direction perpendicular to a discharge direction of the lamp in mm, $D_2$ is an outside dimension of a side of the bulb in the discharge direction of the lamp in mm, $D_3$ is a length of the bulb in mm, and W is a lighting power of the lamp in watts.

3. A metal halide lamp device with a one-piece arrangement of a front cover and a reflector, and a metal halide lamp with a unidirectional base and a unidirectional sealed end positioned within an inner space defined by the front cover and reflector so as to be surrounded thereby; wherein the metal halide lamp is configured in accordance with the relationship $0.07<W/(D_1*D_2*D_3)<0.20$, where $D_1$ is an outside dimension of a front side of a bulb which forms an emission part of the metal halide lamp in a direction perpendicular to a discharge direction of the lamp in mm, $D_2$ is an outside dimension of a side of the bulb in the discharge direction of the lamp in mm, $D_3$ is a length of the bulb in mm, and W is a lighting power of the lamp in watts.

4. A metal halide lamp device with a one-piece arrangement of a front cover and a reflector, and with a metal halide lamp, said metal halide lamp having a unidirectional base, a unidirectional sealed end, and an emission part, and being positioned within an inner space area defined by the front cover and reflector so as to be surrounded thereby; wherein the metal halide lamp is configured in accordance with the relationship $Q_1/Q_2<15$, where $Q_1$ is an unoccupied volume of said inner space area in $cm^3$ and $Q_2$ is a volume of a bulb which forms the emission part of the metal halide lamp in $cm^3$.

5. A metal halide lamp device with a one-piece arrangement of a front cover glass and a reflector, and a metal halide lamp with a unidirectional base and a unidirectional sealed end positioned within an inner space defined by the front cover and reflector so as to be surrounded thereby; wherein the lamp has operating pressure during illumination of at most $3\times10^6$ Pa, an inside volume of the lamp is at most 1 $cm^3$, a distance between a bulb forming an emission part of the lamp and the front cover glass is at most 20 mm, and a value of $T_2/T_1$ is at least equal to 1.6, where $T_1$ is a wall thickness between inner and outer surfaces of the bulb in mm and $T_2$ is a thickness of the front cover glass in mm.

* * * * *